US007331575B2

(12) United States Patent
Kang

(10) Patent No.: US 7,331,575 B2
(45) Date of Patent: Feb. 19, 2008

(54) PRINTER AND METHOD FOR FEEDING SHEETS IN A PRINTER

(75) Inventor: Sung-wook Kang, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 330 days.

(21) Appl. No.: 10/916,514

(22) Filed: Aug. 12, 2004

(65) Prior Publication Data

US 2005/0051945 A1 Mar. 10, 2005

(30) Foreign Application Priority Data

Aug. 13, 2003 (KR) ..... 10-2003-0056008

(51) Int. Cl.
*B65H 3/52* (2006.01)

(52) U.S. Cl. ..... 271/121; 271/124

(58) Field of Classification Search ..... 271/121, 271/124, 167

See application file for complete search history.

(56) References Cited

U.S. PATENT DOCUMENTS

2004/0245703 A1* 12/2004 Yun et al. ..... 271/110

2005/0082742 A1* 4/2005 Kang et al. ..... 271/121

FOREIGN PATENT DOCUMENTS

| | | |
|---|---|---|
| JP | 60-056746 | 4/1985 |
| JP | 06-329269 | 11/1994 |
| JP | 11-0493492 | 2/1999 |
| JP | 2000-168980 | 6/2000 |

* cited by examiner

*Primary Examiner*—David H Bollinger
(74) *Attorney, Agent, or Firm*—Roylance, Abrams, Berdo & Goodman, L.L.P.

(57) ABSTRACT

A printer apparatus and method for sequentially withdrawing sheets loaded into a cassette and printing images on the sheets is provided. The printer includes: a pickup roller for picking up a sheet from a plurality of sheets in the cassette; a resistance member for contacting a front end of the sheets such that the top sheet is separated based on stiffness and picked up from the cassette; and an angle change unit for changing a tilt angle of the resistance member about the front end of the sheets from a first tilt angle to a second tilt angle in a process of picking up the top sheet, and allowing the tilt angle to return to the first tilt angle when the top sheet has been completely picked up.

12 Claims, 12 Drawing Sheets

PRINTER AND METHOD FOR FEEDING SHEETS IN A PRINTER

BACKGROUND OF THE INVENTION

This application claims the benefit under 35 U.S.C. § 119(a) of Korean Patent Application No. 2003-56008, filed on Aug. 13, 2003, in the Korean Intellectual Property Office, the entire contents of which is incorporated herein by reference.

FIELD OF THE INVENTION

The present invention relates to a printer and a method for feeding sheets in the printer. More particularly, the present invention relates to a printer for separating and feeding loaded sheets in accordance with stiffness of the sheets and a corresponding method of feeding the sheets in the printer.

DESCRIPTION OF THE RELATED ART

Printers allow a large number of sheets to be loaded onto a cassette, and to be withdrawn and fed sequentially from the cassette. Examples of a method of sequentially separating the sheets typically include a frictional separation method that uses a frictional plate, and a resistance method that uses stiffness of sheets.

FIG. 1 is a diagram illustrating a conventional arrangement for separating sheets using a resistance method.

Referring to FIG. 1, a large number of sheets are loaded onto a cassette 51. A pickup roller 52 comes into contact with the loaded sheets P. A resistance member 53 having a predetermined tilt angle A is provided on a front end of the sheets P. When the pickup roller 52 rotates, the sheets P are fed. Two or more sheets P are fed via frictional force between the sheets P and reach the resistance member 53. The frictional force between the pickup roller 52 and the sheets P is larger than the frictional force between the sheets P. Therefore, as the pickup roller 52 rotates, only the top sheet P1 in contact with the pickup roller 52 is slipped from the underlying sheets P and fed. The front end of the sheet P1 becomes curved, thereby forming a curl as indicated by a reference numeral C1 in FIG. 1. Due to the rotation of the pickup roller 52, the curl grows as indicated by a reference numeral C2, the curl then gets unfolded instantaneously as indicated by a reference numeral C3 by the stiffness of the sheet P1. Only the sheet P1 is separated and fed.

A tilt angle A of the resistance member 53 is chosen to be suitable for standard size sheets. Therefore, when using thick sheets having a large stiffness, the separation processes C1, C2, and C3 in FIG. 1 are not performed or are improperly performed after the front end of the sheet P reaches the resistance member 53, so that a jam may occur or a pickup error where the sheet P is not fed may occur. Further, overload may be applied to a drive motor (not shown) that drives the pickup roller 52.

In order to solve these problems, if thick sheets are used, the resistance member 53 needs to have a large tilt angle A. Referring to FIG. 2, the resistance member 53 is able to rotate and is elastically biased by a spring 54. Then, when thick sheets P having a large stiffness are fed, the resistance member 53 rotates as indicated by a reference numeral B so as to reduce a load applied to the drive motor (not shown), and the separation processes C1 through C3 are performed. However, in such a construction the tilt angle A may be changed even when using standard size sheets, thereby causing a paper jam.

SUMMARY OF THE INVENTION

Accordingly, embodiments of the present invention provide a printer that can change a tilt angle of a resistance member so as to stably separate and feed standard size sheets and thick sheets having a relatively large stiffness, and a method of feeding sheets in the printer.

According to an aspect of the present invention, there is provided a printer comprising a pickup roller that picks up a sheet from a cassette; a resistance member that comes in contact with a front end of the sheets such that a top sheet is separated by stiffness and picked up from the cassette; and an angle change unit that changes a tilt angle of the resistance member about the front end of the sheets from a first tilt angle to a second tilt angle in the process of picking up the top sheet, and allows the resistance member to return to the first tilt angle when the top sheet has been picked up. The angle change unit may keep the resistance member at the first tilt angle at least for a time required for separating a standard size sheet, and then change the tilt angle of the resistance member to the second tilt angle.

According to another aspect of the present invention, there is provided a method of feeding sheets in a printer comprising a cassette that sheets are loaded into, a pickup roller that comes in contact with a top sheet of the loaded sheets and rotates, and a resistance member that comes in contact with a front end of the sheets such that the top sheet is separated by stiffness and picked up from the cassette. The method comprises changing a tilt angle of the resistance member about the front end of the sheets from a first tilt angle to a second tilt angle in the process of picking up the top sheet; and returning the resistance member to the first tilt angle when the pickup of the top sheet is completed.

BRIEF DESCRIPTION OF THE DRAWINGS

The above and other features and advantages of the present invention will become more apparent by describing in detail exemplary embodiments thereof with reference to the accompanying drawings in which.

Throughout the drawings, it should be noted that the same or similar elements are denoted by like reference numerals.

DETAILED DESCRIPTION OF THE INVENTION

Exemplary embodiments of the present invention will now be described in detail with reference to the accompanying drawings.

Figure 3:
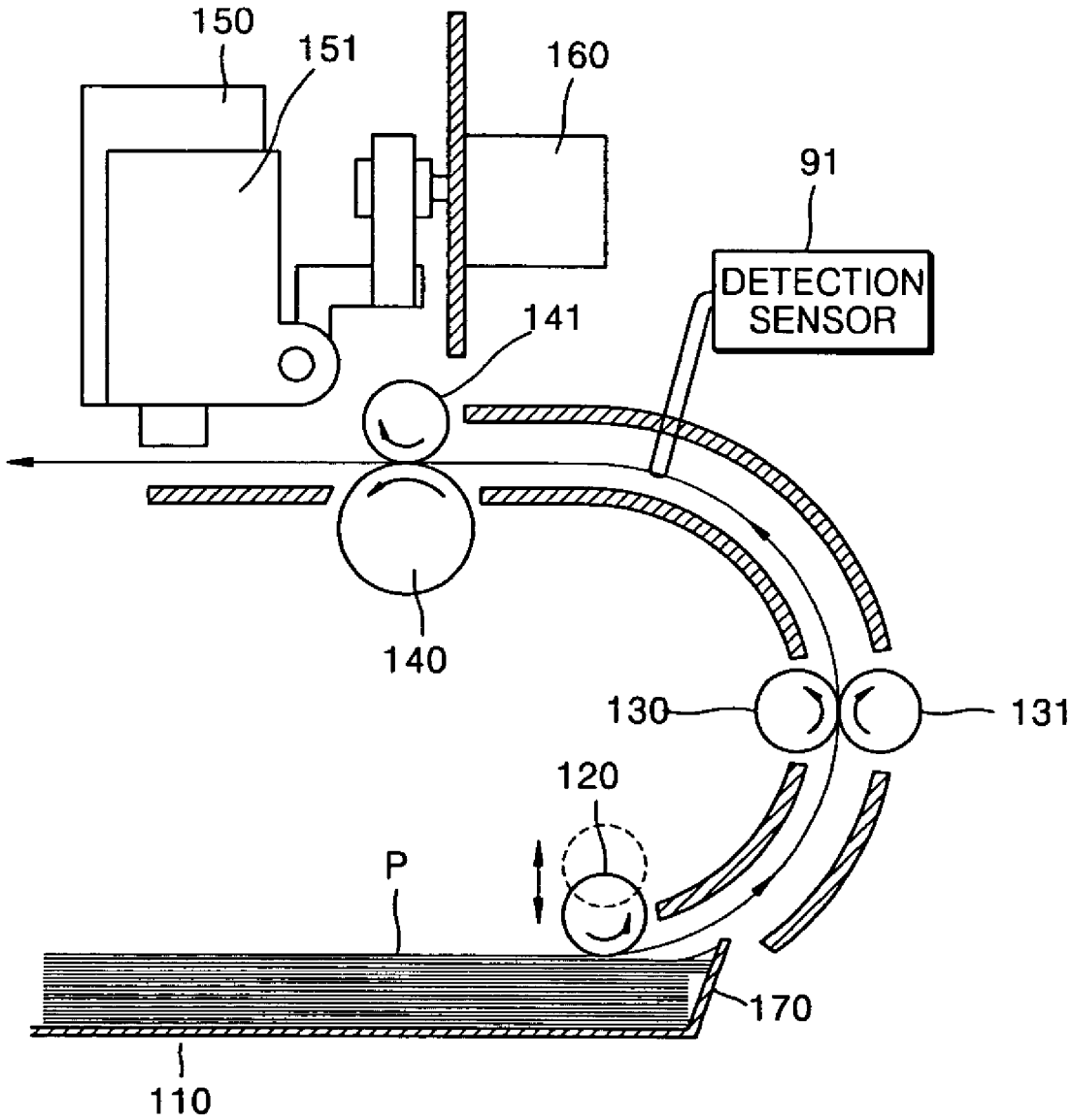
FIG. 3 is a schematic structural diagram of a printer according to an embodiment of the present invention.

FIG. 3 is a schematic structure diagram of a printer according to an embodiment of the present invention. For convenience of explanation, the printer of FIG. 3 is described as an inkjet printer that prints images on sheets by ejecting ink droplets, however, the embodiments of the present invention are not limited to this example.

FIG. 3 illustrates a cassette 110 whereon a number of sheets P are loaded, and a pickup roller 120 and a drive roller 130 that pick up the sheets P from the cassette 110 and supply the sheets P to a feed roller 140 that feeds the sheets P at a predetermined speed. The pickup roller 120 comes in contact with the sheets P loaded on the cassette 110 and rotates when picking up the sheets P, and is separated from the sheets P when the pickup is completed. A driven roller 141 comes in contact with the feed roller 140. A driven roller 131 comes in contact with the drive roller 130. A reference numeral 170 indicates a resistance member that separates the sheets P one by one using a resistance method. A reference numeral 150 indicates a printer head that ejects ink droplets on a sheet and prints images thereon. The print head 150 is mounted on a carriage 151 which is reciprocated in a direction perpendicular to a feed direction of the sheets by means of a carriage motor 160.

Figure 4:
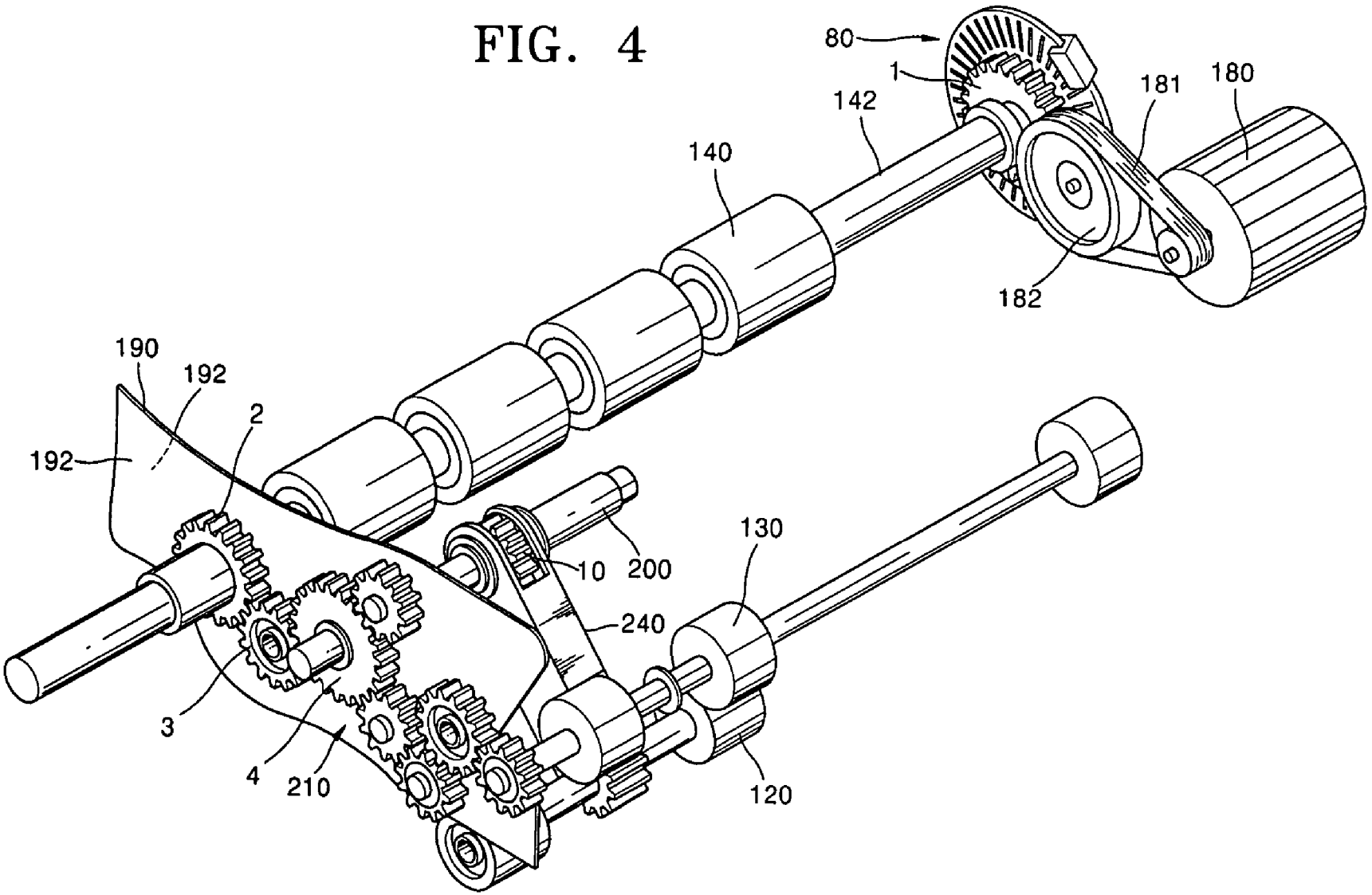
FIG. 4 is a perspective view schematically illustrating a sheet feed system of the embodiment shown in FIG. 3.

FIG. 4 is a perspective view schematically illustrating a sheet feed system in accordance with the embodiment of the invention shown in FIG. 3.

Referring to FIG. 4, a first gear 1 is coupled to an end of a shaft 142 of the feed roller 140. A drive motor 180 is connected to the first gear 1 through a belt 181 and a pulley 182 and makes the feed roller 140 rotate. A gear 2 is coupled to the other end of the shaft 141 of the feed roller 140. The gear 2 is connected to a gear 4 coupled to a pickup shaft 200 through a gear 3.

Figure 6:
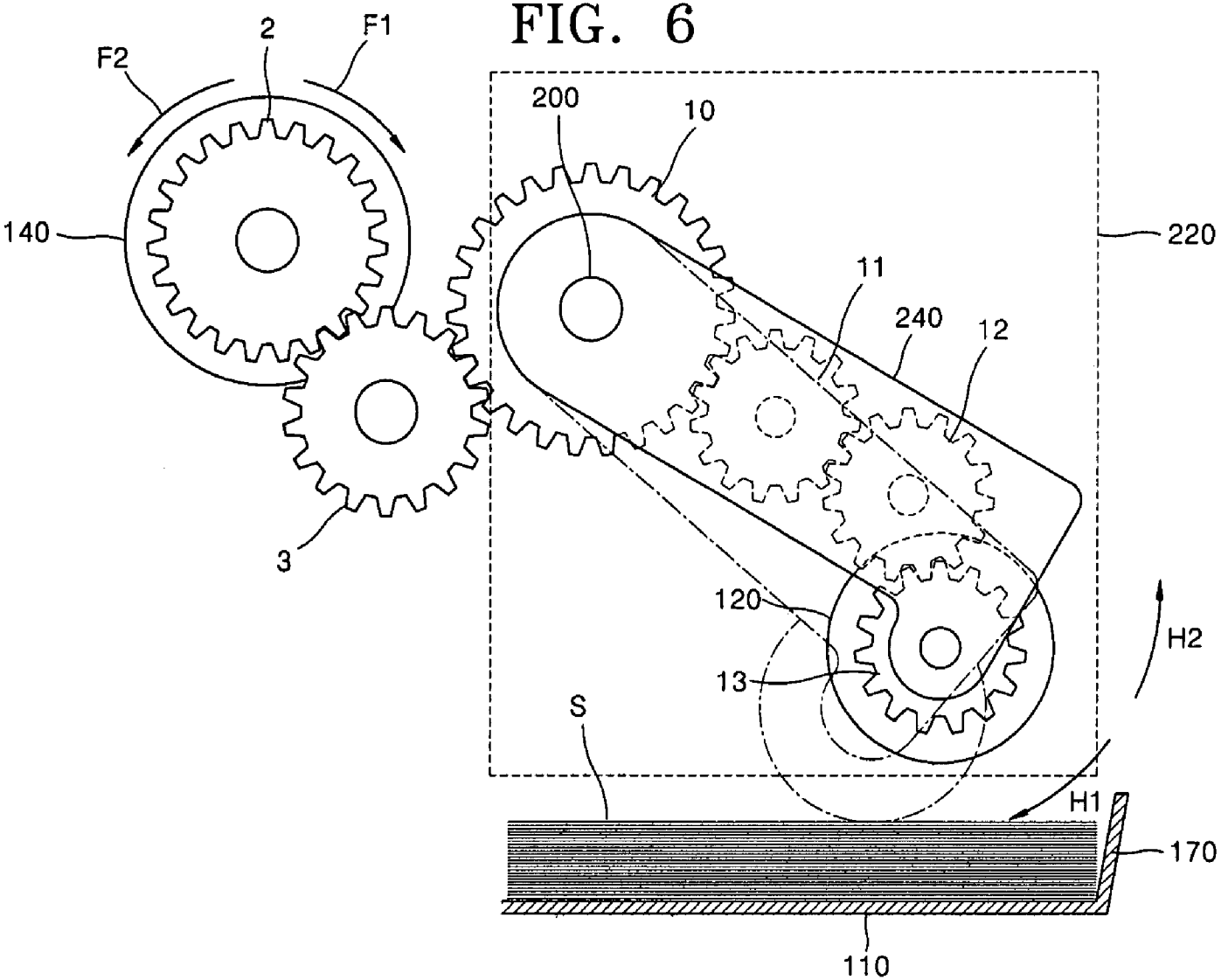
FIG. 6 is a diagram illustrating a second gear train in detail.

A first gear train 210 for driving the drive roller 130 is provided to an outside 191 of a bracket 190. A pickup arm 240 is rotatably installed at the pickup shaft 200. The pickup roller 120 and a second gear train 220 as shown in FIG. 6 are provided in the pickup arm 240. A third gear train 230 for driving cam members 310, 380 to be described later is provided in an inside 192 of the bracket 190, as shown in FIG. 7.

Figure 5:
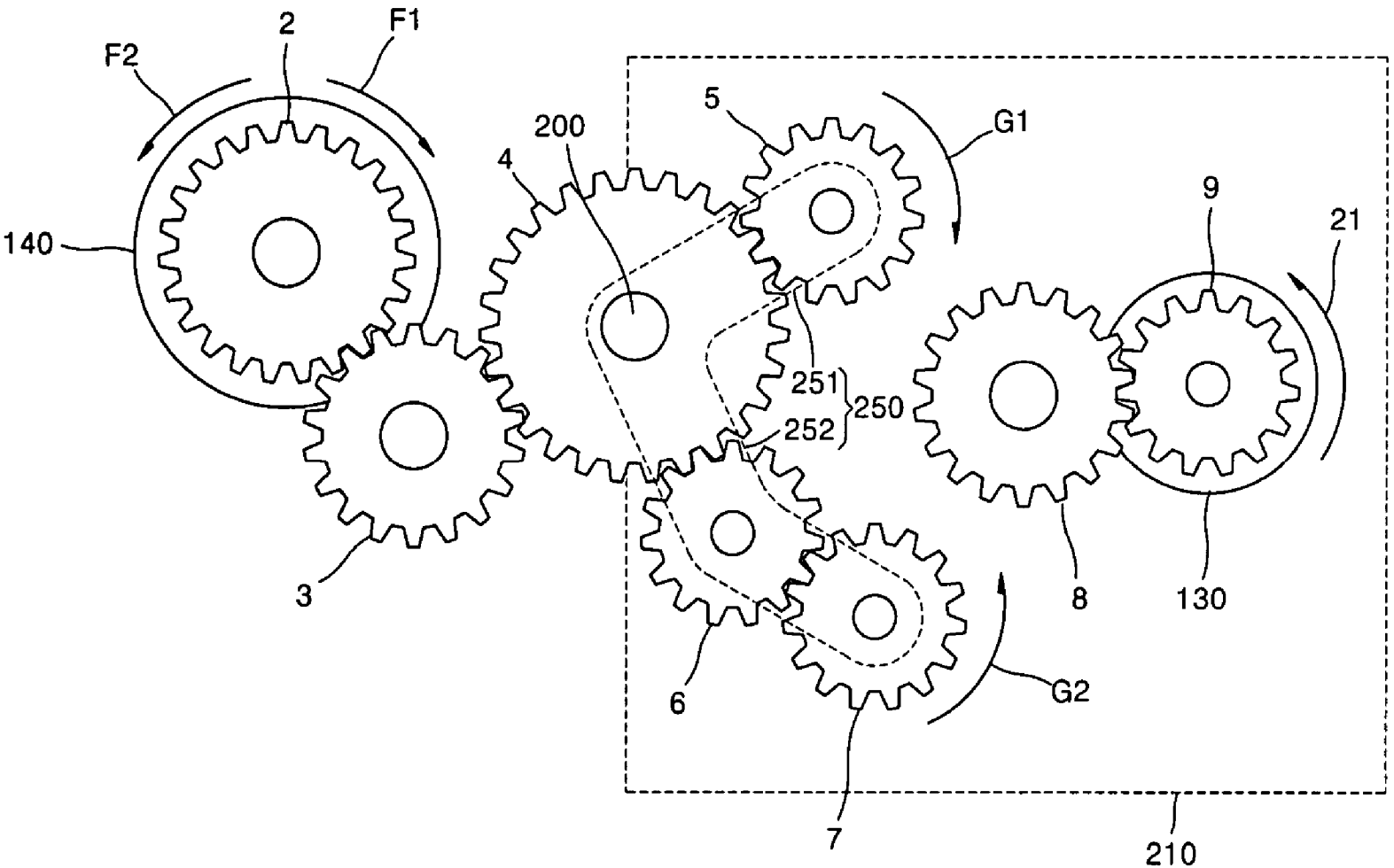
FIG. 5 is a diagram illustrating a first gear train in detail.

FIG. 5 illustrates the first gear train 210 in detail. Referring to FIG. 5, a swing bracket 250 having a first arm 251 and a second arm 252 is rotatably coupled to the pickup shaft 200. A gear 5 is coupled to the first arm 251. A gear 6 and a gear 7 connected to each other are coupled to the second arm 252. The gear 5 and the gear 6 are connected to the gear 4, respectively. When the feed roller 140 rotates in an F1 direction that is opposite to a feed direction of the sheets P, the swing bracket 250 rotates in a G1 direction, and thus the gear 5 is connected to the gear 8. When the feed roller 140 rotates in an F2 direction that is the feed direction of the sheets P, the swing bracket 250 rotates in a G2 direction, and thus the gear 7 is connected to the gear 8. The gear 8 is connected to a gear 9 coupled to one end of the drive roller 130.

FIG. 6 illustrates a second gear train 220 in detail. Referring to FIG. 6, a gear 10 is coupled to the pickup shaft 200. A rotatable pickup arm 240 is provided in the pickup shaft 200. The pickup roller 120 is provided at an end of the pickup arm 240. A gear 13 coupled to the pickup roller 120 is connected to the gear 10 through the gear 11 and the gear 12. When the feed roller 140 rotates in the F1 direction, the pickup arm 240 rotates in an H1 direction, and thus the pickup roller 120 comes in contact with the sheet P and feeds the sheet P. When the feed roller 140 rotates in the F2 direction, the pickup arm 240 rotates in an H2 direction, and thus the pickup roller 120 is separated from the sheet P.

Figure 7:
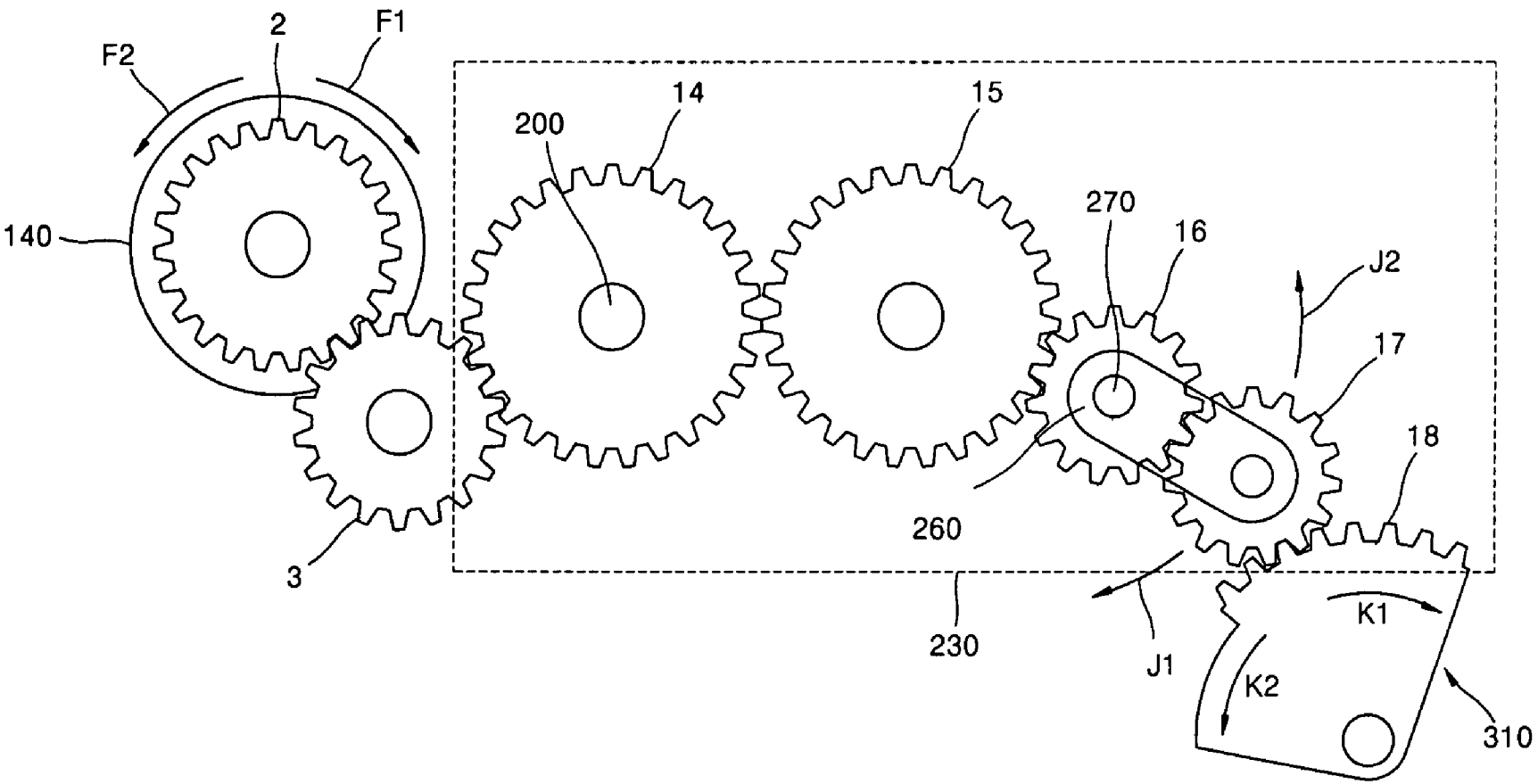
FIG. 7 is a diagram illustrating a third gear train in detail.

FIG. 7 illustrates a third gear train 230 in detail. Referring to FIG. 7, a gear 14 is coupled to the pickup shaft 200. Gears 15, 16, and 17 are connected in turn to the gear 14. A third arm 260 is provided rotatably in a rotational axis 270 of the gear 16. The gear 17 is provided in the third arm 270. When the feed roller 140 rotates in the F1 direction, the third arm 260 rotates in a J1 direction, the gear 17 is connected to a gear portion 18 of the cam member 310, and thus the cam member 310 rotates in a first direction K1. When the feed roller 140 rotates in the F2 direction, the third arm 260 rotates in a J2 direction, the gear 17 is separated from the gear portion 18, and a rotational force of the drive motor 180 is not transferred to the cam member 310.

Figure 8:
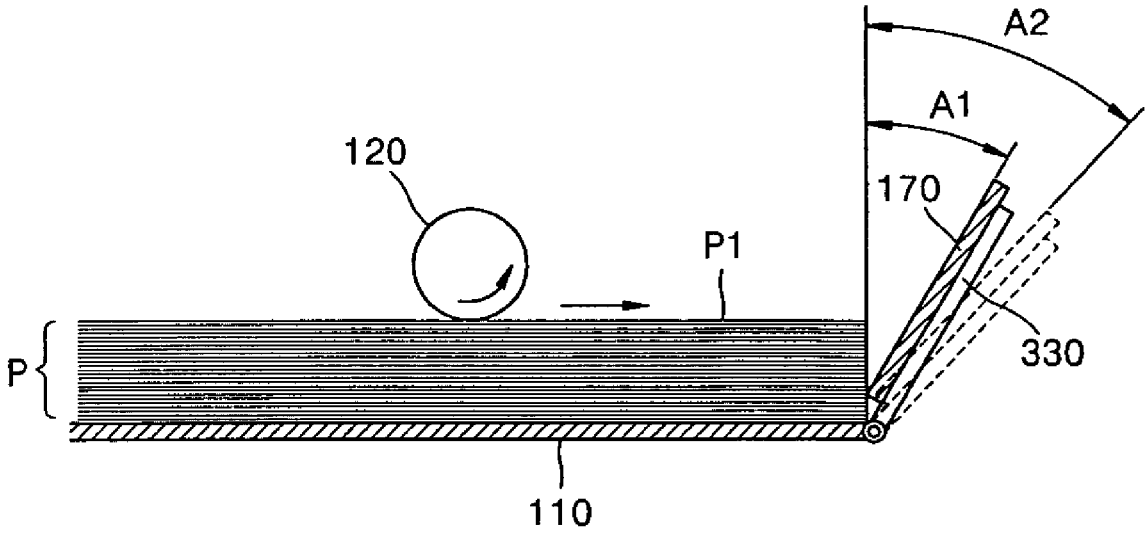
FIG. 8 is a diagram illustrating a first tilt angle and a second tilt angle.

As shown in FIG. 8, the printer according to an embodiment of the present invention is characterized, in that in the process of picking up the sheet P, a tilt angle of the resistance member 170 about the front end of the sheet P is changed from a first tilt angle A1 for separating a standard size sheet to a second tilt angle A2 for separating a thick sheet. In this embodiment of the present invention, by providing the resistance member 170 in a support member 330 and rotating the support member 330, the tilt angle of the resistance member 170 is changed. The first tilt angle A1 is a tilt angle for separating a standard size sheet having an exemplary thickness of about 100 μm or less, and the second tilt angle A2 is a tilt angle for separating a thick sheet having an exemplary thickness of about 100 μm or more having a relatively large stiffness. It is preferable that the second tilt angle A2 is larger than the first tilt angle A1.

Figure 9:
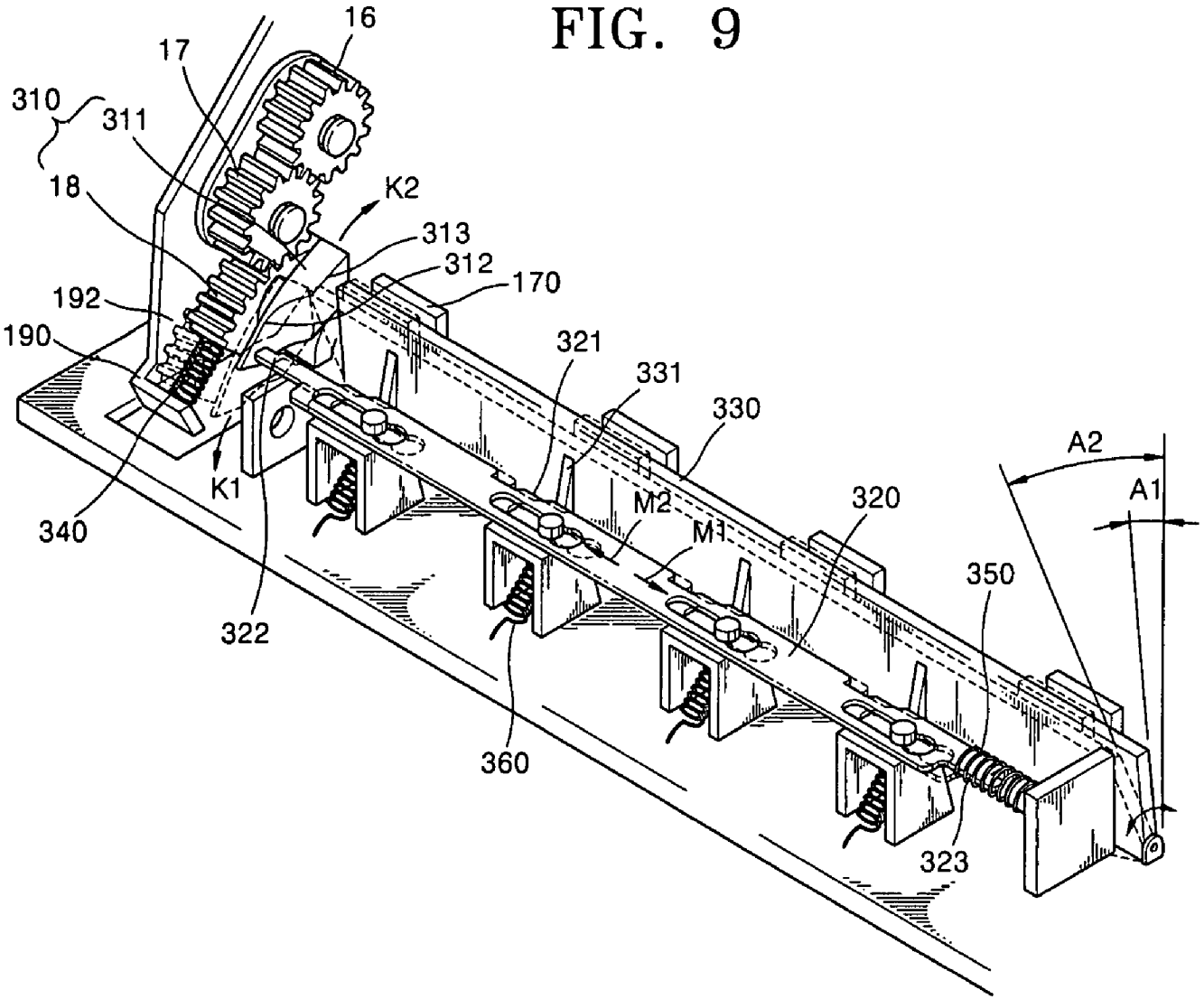
FIG. 9 is a perspective view illustrating an example of an angle change unit that changes a tilt angle of a resistance member.

FIG. 9 illustrates one example of an angle change unit for changing the tilt angle of the resistance member 170.

Referring to FIG. 9, the cam member 310, the sliding member 320, and the support member 330 are illustrated. The cam member 310 is provided in the inside 192 of the bracket 190. A cam profile 311 and the gear portion 18 are provided in the cam member 310. The cam profile 311 is provided with a first section 312 and a second section 313 corresponding to the first tilt angle A1 and the second tilt angle A2 of the resistance member 170, respectively. One end of a compression spring 340 is supported by the bracket 190, and the other end is supported by the cam member 310. The compression spring 340 is elastically biased to allow the cam member 310 to rotate in the second direction K2. A slant portion 321 is provided in the sliding member 320. One end portion 322 of the sliding member 320 is in contact with the cam profile 311. The sliding member 320 slides in a third direction M1 with rotation of the cam member 310 in the first direction K1. A compression spring 350 is provided in the other end 323 of the sliding member 320. The compression spring 350 elastically biases the sliding member 320 to slide in the fourth direction M2. A plurality of resistance members 170 may be provided in the support member 330. An interference portion 331 interfering with the slant portion 321 is provided in the support member 330. A plurality of slant portions 321 and a plurality of interference portions 331 may be provided with the sliding member 320 and the support member 330, respectively. A plurality of tension springs 360 are provided on a back surface of the support member 330. The tension springs 360 elastically biases the support member 330 to rotate to the second tilt angle A2.

A sheet feed method performed in the printer according to an embodiment of the present invention will now be described with reference to FIGS. 3 through 9, and FIG. 1 showing a resistance method.

When a print command is issued by a host (not shown), in order to pick up the sheets P from the cassette 110, the drive motor 180 allows the feed roller 140 to rotate in the F1 direction. Then, as shown in FIG. 6, the pickup arm 240 rotates in the H1 direction, and the pickup roller 120 comes in contact with the sheets P loaded on the cassette 110 and rotates. At this time, as shown in FIG. 5, the swing bracket 250 rotates in the G1 direction, and thus the gear 5 is connected to the gear 8, whereby the drive roller 130 rotates in a direction 21 of FIG. 5. Further, as shown in FIG. 7, the third arm 260 rotates in the J1 direction, and thus the gear 17 is connected to the gear portion 18. The cam member 310 rotates in the first direction K1. Due to the rotation of the pickup roller 120, the sheet P1 loaded on the top of the cassette 110 is separated from the sheets P through the processes C1, C2, and C3 of FIG. 1, picked up from the cassette 110, and drawn into the feed roller 140 by means of the drive roller 130.

In this process, the tilt angle of the resistance member 170 is changed from the first tilt angle A1 to the second tilt angle A2. Referring to FIG. 9, the end portion 322 of the sliding member 320 is in contact with the first section 312 of the cam profile 311. When the cam member 310 rotates in the first direction K1, the sliding member 320 slides in the third direction M1 as indicated by dotted lines in FIG. 9 in a state where the second section 313 of the cam profile 311 is in contact with the end portion 322 of the sliding member 320. The support member 330 is elastically biased to rotate to the second tilt angle A2 by means of the tension spring 360. When the sliding member 320 slides in the third direction M1, the support member 330 naturally rotates to the second tilt angle A2 by means of the elastic force of the tension spring 360. In this way, the tilt angle of the resistance member 170 is changed from the first tilt angle A1 to the second tilt angle A2. It is preferable that the resistance member 170 is kept at the first tilt angle A1 for a predetermined time and is changed to the second tilt angle A2.

Figure 10:
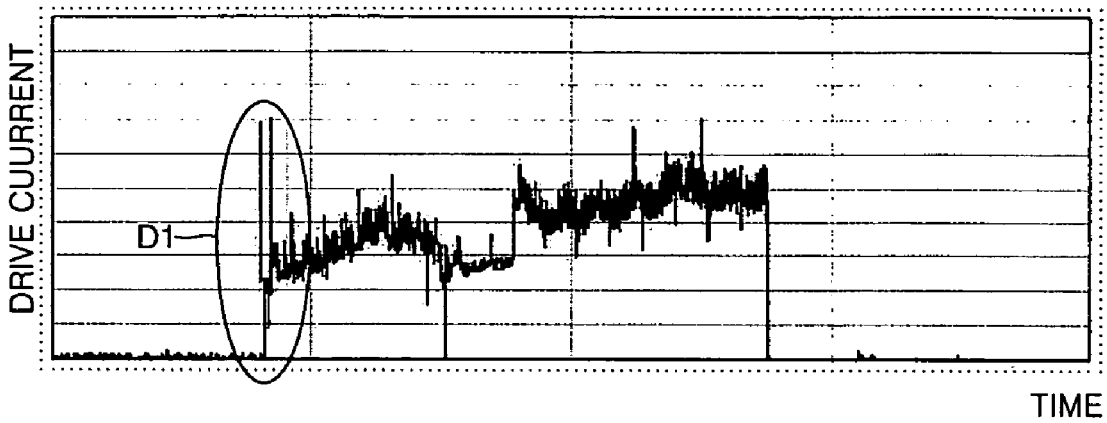
FIGS. 10 and 11 are graphs illustrating drive currents of a drive motor that drives a pickup roller when separating a standard size sheet and a thick sheet in a state where the resistance member is fixed to the first tilt angle.
Figure 11:
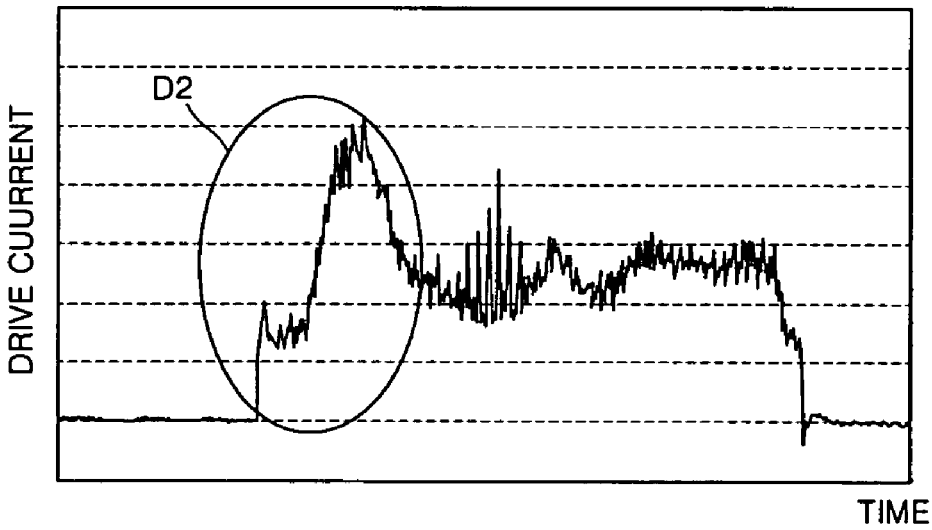

FIGS. 10 and 11 are graphs illustrating drive currents of the drive motor 180 that drives the pickup roller 120 when separating the standard size sheet and the thick sheet in a state where the resistance member 170 is fixed to the first tilt angle A1.

Figure 1:
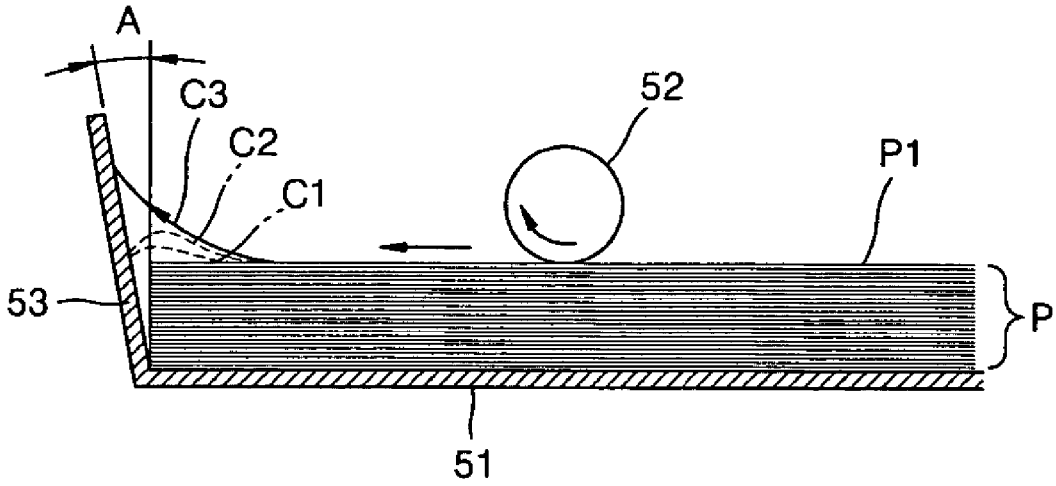
FIG. 1 (PRIOR ART)
FIG. 1 is a cross-sectional diagram illustrating a conventional arrangement for separating sheets using a resistance method.
Figure 2:
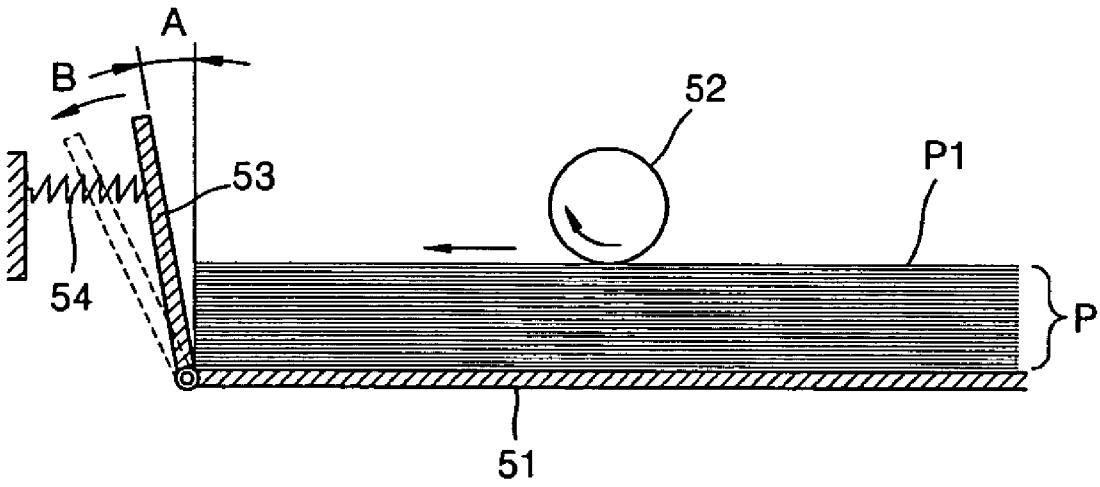
FIG. 2 (PRIOR ART)
FIG. 2 is a cross-sectional diagram illustrating another example of a resistance arrangement.

Referring to FIG. 10, when separating the standard size sheet, the amount of drive current is increased instantaneously as indicated by a reference numeral D1. At this time, the separation processes C1 through C3 of FIG. 1 are performed. Referring to FIG. 11, when separating the thick sheet, as indicated by a reference numeral D2, the drive current is increased for a longer time period than that for separating the standard size sheet, is maintained for a time, and is decreased again. The drive current is decreased when separation of the sheet P is completed.

A time required for separating the sheet P is about 0.01 second in the case of the standard size sheet, and is about 0.13 second in a case of the thick sheet, although it was not illustrated in detail in FIGS. 10 and 11. In other words, a time interval for keeping the tilt angle of the resistance member 170 to the first tilt angle A1 for separating the standard size sheet is about 0.1-0.2 seconds. This time interval can be determined by experimentation by considering various variables such as a friction coefficient of the pickup roller 120, a contact pressure between the pickup roller 120 and the sheet P, and so on. In consideration of the time interval, a length of the first section 312 of the cam profile 311 is determined.

The pickup process is completed by aligning the front end of the sheet P to the feed roller 140 after the front end of the sheet P is detected by a detection sensor (91 of FIG. 3). Then, the drive motor 180 allows the feed roller 140 to rotate in the F2 direction. Then, the sheet P passes between the feed roller 140 and the driven roller 141, the print head 150 ejects ink droplets to the sheet P, thereby forming images on the sheet P. At this time, as shown in FIG. 5, the swing bracket 250 rotates in the G2 direction, the gear 5 is separated from the gear 8, and the gear 7 is connected to the gear 8. Therefore, the drive roller 130 rotates continuously in the direction 21 of FIG. 5. Further, referring to FIG. 6, the pickup arm 240 rotates in the H2 direction, and the pickup roller 120 is separated from the sheet P. In this way, by separating the pickup roller 120 from the sheet P after pickup of the sheet P is completed, a load applied to the drive motor 180 can be reduced. Furthermore, referring to FIGS. 7 and 9, since the third arm 260 rotates in the J2 direction, the gear 17 is separated from the gear portion 18 of the cam member 310, and the cam member 310 rotates in the second directions K2 by means of the elastic force of the compression spring 340. The compression spring 350 pushes the sliding member 320 in the fourth direction M2. The slant portion 321 pushes the interference portion 331, thereby allowing the support member 330 to rotate to the first tilt angle A1. Therefore, the tilt angle of the resistance member 170 about the front end of the sheet P returns to the first tilt angle A1 from the second tilt angle A2.

Conventionally, as mentioned above, since the tilt angle of the resistance member 170 has been fixed to an angle suitable for separating the standard size sheet, the thick sheet having a large stiffness has not been separated well, and thus jams may occur, or since the resistance is too large, pickup errors that the sheets P has not been fed may occur. However, in the printer and the sheet feed method according to an embodiment of the present invention, at the initial stage of the process of picking up the sheet P, the tilt angle of the resistance member 170 about the front end of the sheet P is kept at the first tilt angle A1 suitable for separating the standard size sheet, and by changing the tilt angle to the second tilt angle A2 suitable for separating the thick sheet after a predetermined time, both of the standard size sheet and the thick sheet P can be stably separated and fed.

Figure 12:
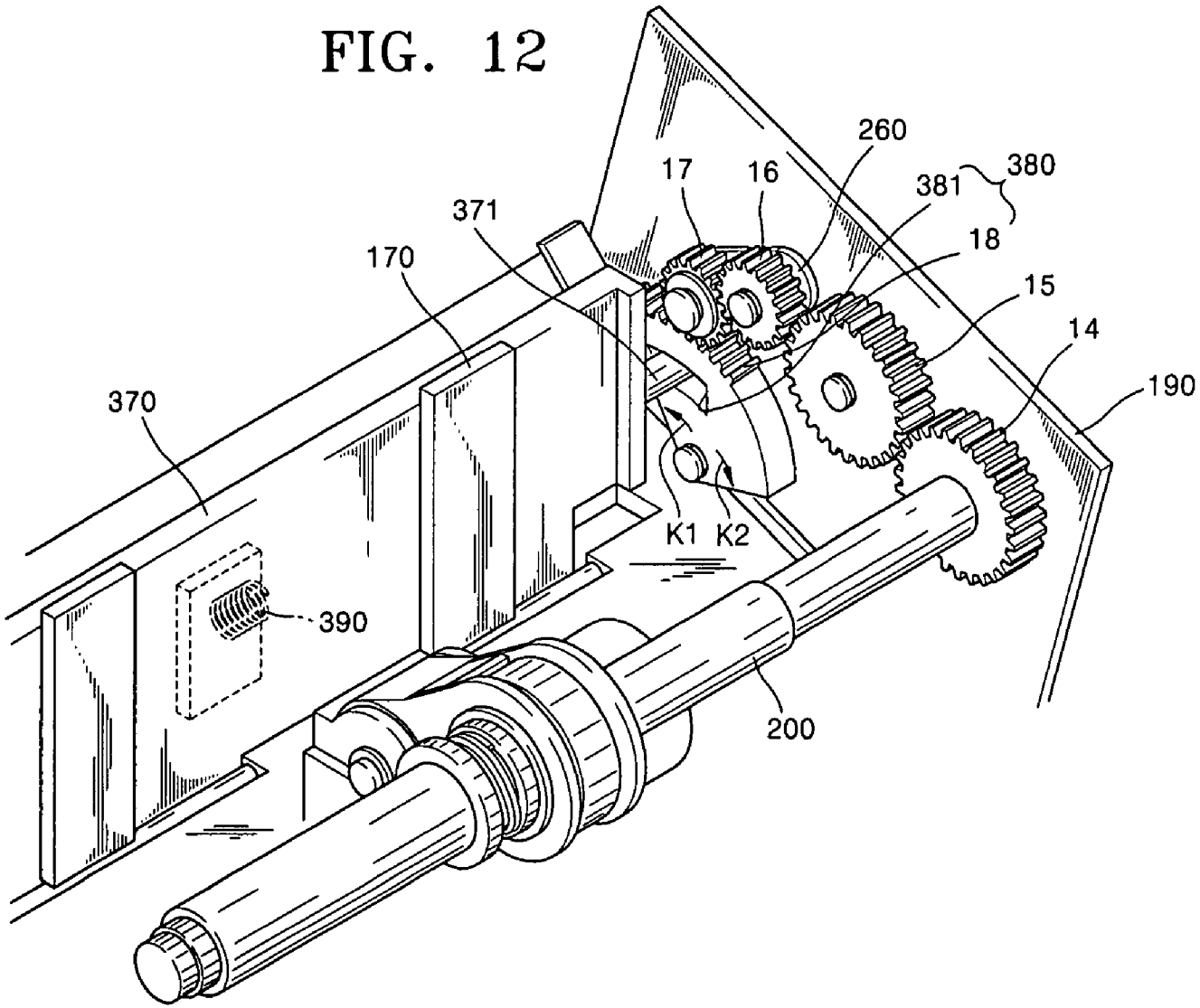
FIG. 12 is a perspective view illustrating another example of the angle change unit.
Figure 13:
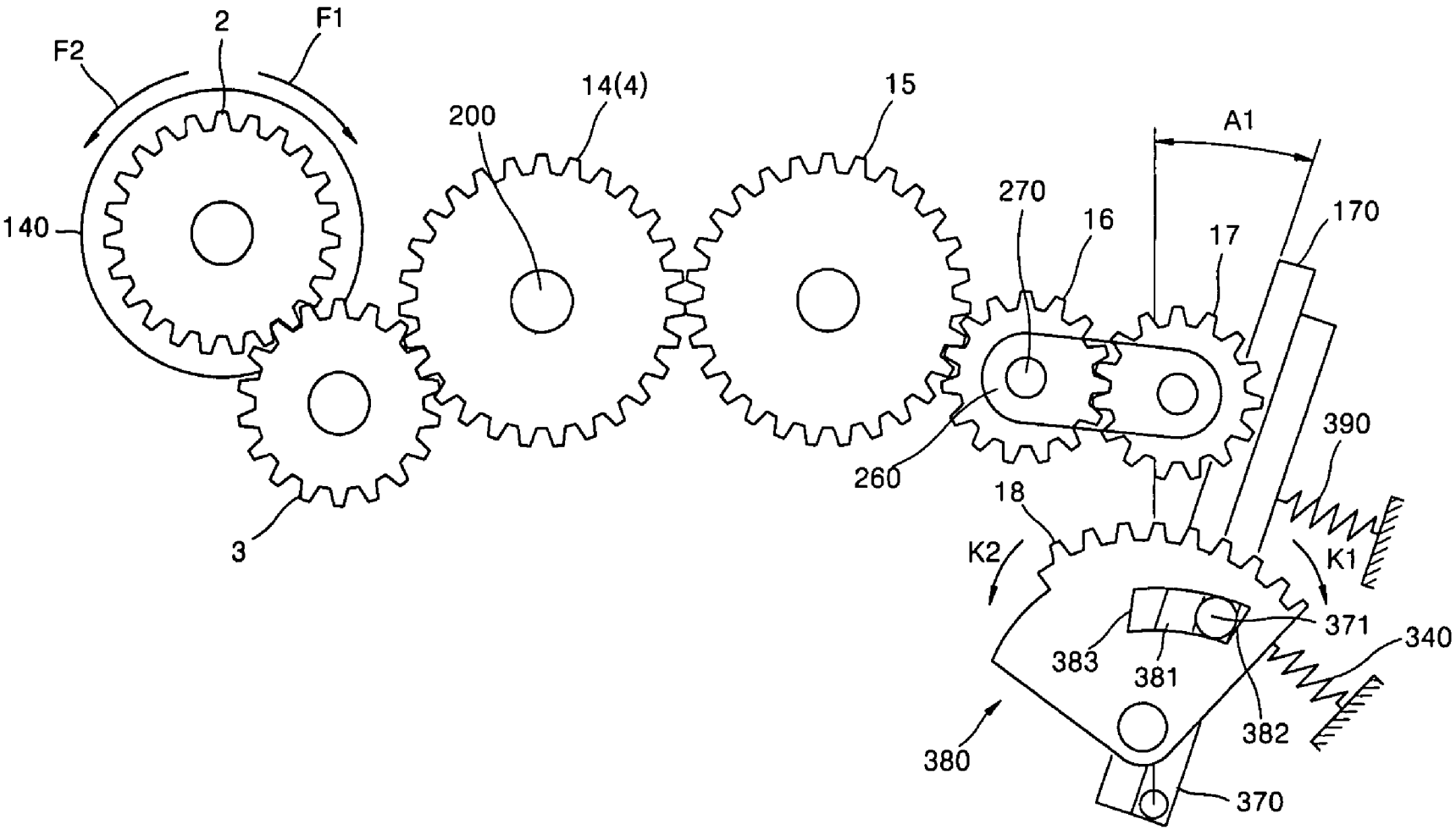
FIG. 13 is a schematic side view of the angle change unit of FIG. 12.
Figure 14:
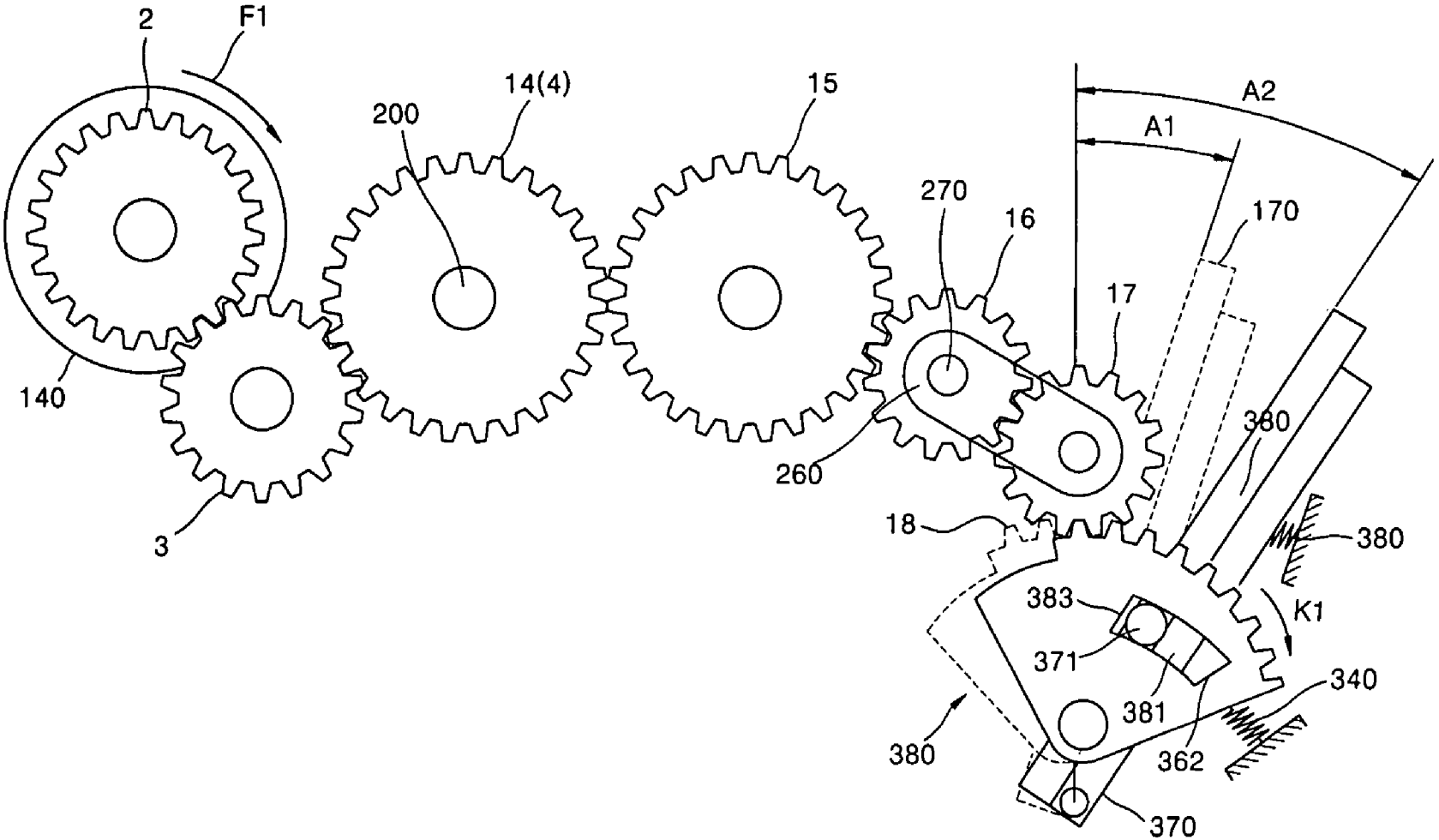
FIG. 14 is a diagram illustrating an operation of the angle change unit shown in FIGS. 12 and 13.

FIG. 12 is a perspective view illustrating another example of the angle change unit. FIG. 13 is a schematic side view of the angle change unit of FIG. 12. FIG. 14 is a diagram illustrating an operation of the angle change unit shown in FIGS. 12 and 13.

In FIGS. 12 and 13, the support member 370 and the cam member 380 are illustrated. The resistance member 170 is provided in the support member 370. A projected portion 371 is provided at one side of the support member 370. A reference numeral 390 indicates a tension spring for elastically biasing the support member 370 toward the first tilt angle A1. The gear portion 18, which is connected to the gear 17 when the feed roller 140 rotates in the F1 direction, is provided in the cam member 380. The cam member 380 rotates in the first direction K1 when the feed roller 140 rotates in the F1 direction. A reference numeral 340 indicates a compression spring that elastically biases the cam member 380 to rotate in the second directions K2. A cam profile 381 recessed in an arc shape is provided in the cam member 380. The projected portion 371 is inserted into the cam profile 381.

At the initial stage, as shown in FIG. 13, the support member 370 has the first tilt angle A1. For this purpose, although not shown, the support member 370 is supported by the compression spring 390 to be pushed no more from the position where the support member 370 has the first tilt angle A1. Referring to FIG. 13, the projected portion 371 is in contact with the first end portion 382 of the cam profile 381. When the feed roller 140 rotates in the F1 direction, the cam member 380 rotates in the first direction K1. At this time, until the first end portion 383 of the cam profile 381 comes in contact with the projected portion 371, the support member 370 keeps the first tilt angle A1. If the first tilt angle A1 is maintained, that is, a distance from the first end portion 382 to the second end portion 383 can be determined as shown in FIGS. 10 and 11. When the second end portion 383 of the cam profile 381 comes in contact with the projected portion 371, the support member 370 rotates to the second tilt angle A2, as shown in FIG. 14, with rotation of the cam member 380 in the first direction K1. When the pickup of a sheet is completed and the feed roller 140 rotates in the F2 direction, the gear 17 is separated from the gear portion 18, and the cam member 380 rotates in the second directions K2 by means of the compression spring 340. The support member 370 rotates to the first tilt angle A1 by means of the compression spring 390.

The printer and the sheet feed method according to embodiments of the present invention can be applied regardless of the type of the printer used as long as the printer separates sheets using a resistance method.

As described above, in the printer and the sheet feed method according to embodiments of the present invention, it is possible to stably separate and feed both standard size sheets and thick sheets having a relatively large stiffness, so that jams or a pickup errors can be eliminated or reduced.

While the present invention has been particularly shown and described with reference to the exemplary embodiments thereof, it should be understood by those skilled in the art that various changes in form and details may be made therein without departing from the spirit and scope of the present invention as defined by the appended claims.

What is claimed is:

1. A printer comprising:

a pickup roller for picking up a sheet from a plurality of sheets in a cassette;

a resistance member for contacting a front end of the sheet such that a top sheet is separated based on a stiffness of the sheet and picked up from the cassette; and an angle change unit for changing a tilt angle of the resistance member about the front end of the sheets from a first tilt angle to a second tilt angle in the process of picking up the top sheet based on the thickness of the sheet, and allowing the resistance member to return to the first tilt angle when the top sheet has been completely picked up.

2. The printer according to claim 1, wherein the angle change unit maintains the resistance member at the first tilt angle at least for a time required for separating a standard size sheet, and then changes the tilt angle of the resistance member to the second tilt angle.

3. The printer according to claim 1, wherein the angle change unit comprises:

a cam member having a cam profile, the cam member rotating in a first direction with rotation of the pickup roller and being elastically biased to rotate in a second direction that is opposite to the first direction;

a sliding member having a slant portion, the sliding member sliding in a third direction by means of the cam profile when the cam member rotates in the first direction and being elastically biased to slide in a fourth direction that is opposite to the third direction; and a support member provided with the resistance member, the support member having an interference portion interfering with the slant portion and being elastically biased toward the second tilt angle, and wherein by interfering with the interference portion, the slant portion allows the support member to rotate to the second tilt angle when the sliding member slides in the third direction and return to the first tilt angle when the sliding member slides in the fourth direction.

4. The printer according to claim 3, wherein the cam profile has a first section and a second section corresponding to the first tilt angle and the second tilt angle, respectively, and the first section is kept at least for a time required for separating a standard size sheet.

5. The printer according to claim 1, wherein the angle change unit comprises:

a cam member having a cam profile recessed in an arc shape, the cam member rotating in a first direction with rotation of the pickup roller and being elastically biased to rotate in a second direction that is opposite to the first direction; and a support member provided with the resistance member, the support member having a projected portion to be inserted into the cam profile and being elastically biased to rotate to the first tilt angle, and wherein the cam profile allows the support member to rotate to the second tilt angle when the cam member rotates in the first direction and return to the first tilt angle when the cam member rotates in the second direction.

6. The printer according to claim 5, wherein the cam profile has a first end portion and a second end portion, wherein the projected portion is first in contact with the first end portion, and with rotation of the cam member in the first direction, the second end portion comes in contact with and pushes the projected portion, thereby allowing the support member to rotate to the second tilt angle, and wherein the first end portion and the second end portion have a temporal distance at least larger than a time required for separating a standard size sheet.

7. The printer according to claim 1, wherein the first tilt angle accommodates a sheet thickness up to 100 um.

8. The printer according to claim 1, wherein the second tilt angle accommodates a sheet thickness at or above 100 um.

9. A method of feeding sheets in a printer comprising a cassette that sheets are loaded into, a pickup roller that comes in contact with a top sheet of the loaded sheets and rotates, and a resistance member that comes in contact with a front end of the sheets such that the top sheet is separated by stiffness and picked up from the cassette, the method comprising:

maintaining a tilt angle of the resistance member about the front end of the sheets at a first tilt angle for a predetermined time;

changing the tilt angle of the resistance member to a second tilt angle larger than the first tilt angle in the process of picking up the top sheet; and allowing the resistance member to return to the first tilt angle when the pickup of the top sheet is completed.

10. The method according to claim 9, wherein the predetermined time is for a time required for separating a standard size sheet.

11. The method according to claim 9, further using the first tilt angle to accommodate a sheet thickness up to 100 um.

12. The method according to claim 9, further using the second tilt angle to accommodate a sheet thickness at or above 100 um.

* * * * *